United States Patent [19]

Sehl

[11] Patent Number: 5,020,737

[45] Date of Patent: Jun. 4, 1991

[54] TOW-LINE WINDING DEVICE

[75] Inventor: Douglas Sehl, Waterdown, Canada

[73] Assignee: The Ski-Ease Limited Partnership, Waterdown, Ontario, Canada

[21] Appl. No.: 435,926

[22] Filed: Nov. 14, 1989

Related U.S. Application Data

[63] Continuation of Ser. No. 242,661, Dec. 9, 1988, Pat. No. 4,930,719.

[30] Foreign Application Priority Data

Apr. 8, 1988 [CA] Canada ..... 563628

[51] Int. Cl.[5] ..... B65H 75/34; B66D 1/14

[52] U.S. Cl. ..... 242/86.5; 254/345

[58] Field of Search ..... 242/86.5 A; 254/345, 254/346; 114/253, 254

[56] References Cited

U.S. PATENT DOCUMENTS

| | | | |
|---|---|---|---|
| 625,974 | 5/1899 | Hansen | 254/346 |
| 2,998,796 | 9/1961 | Wittrock | 242/86.5 A |
| 3,162,395 | 12/1964 | Bray | 242/86.5 A |
| 3,242,895 | 3/1966 | Hornby | 242/86.5 A |
| 3,326,493 | 6/1967 | Bondeson | 114/254 |
| 3,498,563 | 3/1970 | Palmieri | 242/86.5 A |
| 3,813,055 | 5/1974 | Pickrell | 242/86.5 A |
| 3,831,545 | 8/1974 | Cain | 242/86.5 A |
| 3,890,918 | 6/1975 | Sell | 114/253 |
| 4,130,176 | 12/1978 | Paulie | 254/345 |
| 4,304,372 | 12/1981 | Smith | 242/865 A |
| 4,407,460 | 10/1983 | Khudaverdian | 114/254 |
| 4,566,674 | 1/1986 | Ebey et al. | 254/345 |
| 4,588,167 | 5/1986 | Finzel | 254/346 |
| 4,641,597 | 2/1987 | Paxton | 114/253 |
| 4,738,216 | 4/1988 | Camarota | 114/253 |

FOREIGN PATENT DOCUMENTS

| | | | |
|---|---|---|---|
| 667552 | 7/1963 | Canada | 242/86.5 A |
| 1230849 | 9/1960 | France | 114/254 |

*Primary Examiner*—Katherine Matecki

*Attorney, Agent, or Firm*—Patrick J. Hofbauer

[57] ABSTRACT

A device for winding and unwinding a waterski tow-line comprises a substantially enclosed housing having a spool mounted for rotation in the housing. A driven gear is mounted on the spool for rotational driving thereof. A drive shaft is journaled in the housing for rotation and for axial sliding relative to the housing and the drive shaft has a first end portion protruding from the housing and a second end portion extending into the housing. A drive gear is rigidly affixed to the drive shaft for rotation and for axial sliding with it. A spring is mounted in the housing to bias the drive gear into meshing engagement with the driven gear. A crank lever is pivotally connected to the second end portion of the drive shaft by an eccentrically positioned pivot pin.

9 Claims, 5 Drawing Sheets

2
21
31
31a
29
25
20
10
33
76
27
66
67
65
71
81
70
69
63
72
64
85
39
20a
35
52
37
54
23
3
45
62
60
58
48
56
22
24
26
51
32
28
34
49
36
30
40
20b
50
38
57
55
46
87
59
42

TOW-LINE WINDING DEVICE

BACKGROUND OF THE INVENTION

This application is a continuation of commonly held co-pending U.S. Application Ser. No. 07/242,661, filed Dec. 9, 1988, now U.S. Pat. No. 4,930,719, issued June 5, 1990, in the name of the same inventor and is entitled to the benefit conferred under 35 USC 120.

FIELD OF THE INVENTION

This invention relates to the sport of waterskiing, and is more particularly concerned with a device for winding and unwinding a tow-line such as is used for towing a waterskier. The device may be used in either its loaded or unloaded configuration, in the sense that the waterskier may be attached or unattached to the handle end of the tow-line.

DESCRIPTION OF THE RELATED ART

In waterskiing a tow-line is attached to the stern of a boat to pull the waterskier through the water. The tow-line is typically mounted to the stern by means of a conventional ski pin fastener mounted on the transom or rear deck, or may, in boats more specialized for waterskiing, be mounted on the upright free end of a ski-post mounted on the stern of the boat. Regardless of the specifics of mounting of the tow-line, it is always a serious problem, from both the safety and convenience standpoints, to keep the tow-line untangled and out of the way of the boat occupants. Moreover, serious drawbacks are associated with casting the tow-line into the water for use by the skier. For instance, the line often becomes entangled, hazardously requiring the skier to remain motionless in the water while untangling the line. Additionally, a line hanging into the water may become entangled in the boat propeller with possible damage to the boat and/or injury to the skier or boat operating personnel. Accordingly, the need for keeping a ski tow-line neatly stowed and for paying out the rope in a controlled, orderly manner has long been recognized by the boating community.

Various forms of reels or spools have been developed to store the tow-line and to allow its payout to the skier during use, as well as for retrieval of the tow-rope. Examples of such devices can be seen in the following prior art patents:

| U.S. Pat. No. | Patentee |
|---|---|
| 2,998,796 | Wittrock |
| 3,326,493 | Bondesen et al |
| 3,498,563 | Palmieri |
| 3,813,055 | Pickrell |
| 3,831,545 | Cain |

However, these and other known devices have all failed to obtain a level of acceptability among the boating community because of their common failure to address the major problems peculiar to their use. For example, because a sporting boat such as may be used in waterskiing is often used for other purposes, aesthetic considerations and safety precautions dictate that a tow-line winding or storage device be removed from its prominent normal operative location and be stored when waterskiing is not contemplated. In other words, a successful device must be quickly detachable from the boat without the use of hand tools. Moreover, the device must be compact, and, ideally, is buoyant to prevent its loss upon accidental dropping overboard. In contrast with the requirement to be lightweight and portable, the device must be robust in its construction, so as to be able to sustain the stress-loading associated with pulling one or more waterskiers behind the boat.

While prior art devices, for example, as shown in U.S. Pat. No. 3,326,493, may exhibit the required degree of robustness, they are neither compact nor portable. Moreover, attachment of such prior art devices to the boat is permanent in nature and requires the use of hand tools. Moreover, the unnecessary complexity of prior devices such as shown in the U.S. Pat. No. 3,326,493 Patent makes the pricing thereof prohibitive to the majority of sport-skiers.

Other prior art devices having some degree of compactness and portability, such as shown in, for example U.S. Pat. No. 3,831,545, are, unfortunately, not sufficiently robust so as to sustain the stress-loading of an attached waterskier. As such they may only be used when the tow-line is unloaded, thus requiring the user to detach the tow-line from the spool after payout for attachment to a more rigid structure of the boat. This requirement for detachment of the tow-line largely defeats the convenience of using the device, thereby rendering it impractical to use.

It is a primary object of the present invention to provide a device for winding and unwinding waterski tow-lines which device overcomes the drawbacks associated with the prior art by being compact, lightweight and simple to manufacture, while being robust in structure, so as to be able to withstand the forces imposed by one or more towed waterskiers.

It is a further object of the present invention to provide a device which is quickly and easily detachable from the ski-boat for storage, once the tow-line has been retracted.

It is yet a further object of this invention to provide a tow-line winding and unwinding device which may be used with existing tow-line fittings commonly installed on ski-boats. In this manner, no modifications or additions are necessary to accommodate usage of the present invention with such existing hardware.

It is a further object of the present invention to provide a winding and unwinding device for ski tow-lines which device does not require the use of hand tools for its installation.

Another object of the invention is to provide a payout and retrieval apparatus of the type described which has a gear drive facilitating manual operation thereof, the gear drive being disengagable to allow free-wheeling of the spool of the apparatus, so that weak drag forces exerted on the floating tow-line may cause spool rotation and pay-out of the tow-line through an opening in the housing of the device.

SUMMARY OF THE INVENTION

A device for winding and unwinding a waterski tow-line in accordance with the invention comprises a substantially enclosed housing having an opening through which tow-line may freely pass. A spool means is mounted in the housing and adapted for retaining the tow-line in winding relation around a centrally disposed axle portion of the spool means. A driven gear is mounted on the spool for rotational driving thereof, and a drive shaft is journaled in the housing for rotation and for axial sliding relative to the housing. The drive shaft has a first end portion protruding from the housing and the second end portion extending into the housing. A drive gear is affixed to the second end portion of the drive shaft for rotation and for axial sliding therewith. A spring means is mounted in the housing and adapted for biasing the drive gear into meshing engagement with the drive gear. A crank member, having a handle portion adjacent one of its ends and a yoke portion adjacent to its opposite other end is pivotally connected to the second end portion of the drive shaft by a pivot pin passing eccentrically through the yoke portion and the second end portion. With this arrangement, upon pivoting movement of the crank member to a first orientation generally transverse to the axis of the drive shaft, the yoke portion urgingly contacts the housing so as to cause axial sliding of the drive shaft in a first axial direction against the biasing of the spring means. thereby causing disengagement of the drive gear from the driven gear, so as to allow for free rotation of the spool means and consequential unwinding of the tow-line from said axle portion of the spool means, and such that, upon pivoting movement of the crank member to a second orientation, which orientation is 180° opposite to the said first orientation, the yoke portion is removed from contact with the housing so as to allow the drive shaft to slide in an axially opposite second direction, under biasing of the spring means, so as to cause engagement of the drive gear with the driven gear. In this manner, the operator is able to provide for controlled rotation of the spool means upon rotation of the crank member, thereby to wind the tow-line around said axle portion of the spool means.

BRIEF DESCRIPTION OF THE DRAWINGS

A preferred embodiment of the invention will now be described in detail by way of example only, with reference to the accompanying drawings in which.

DESCRIPTION OF THE PREFERRED EMBODIMENT

Figures 1, 2:
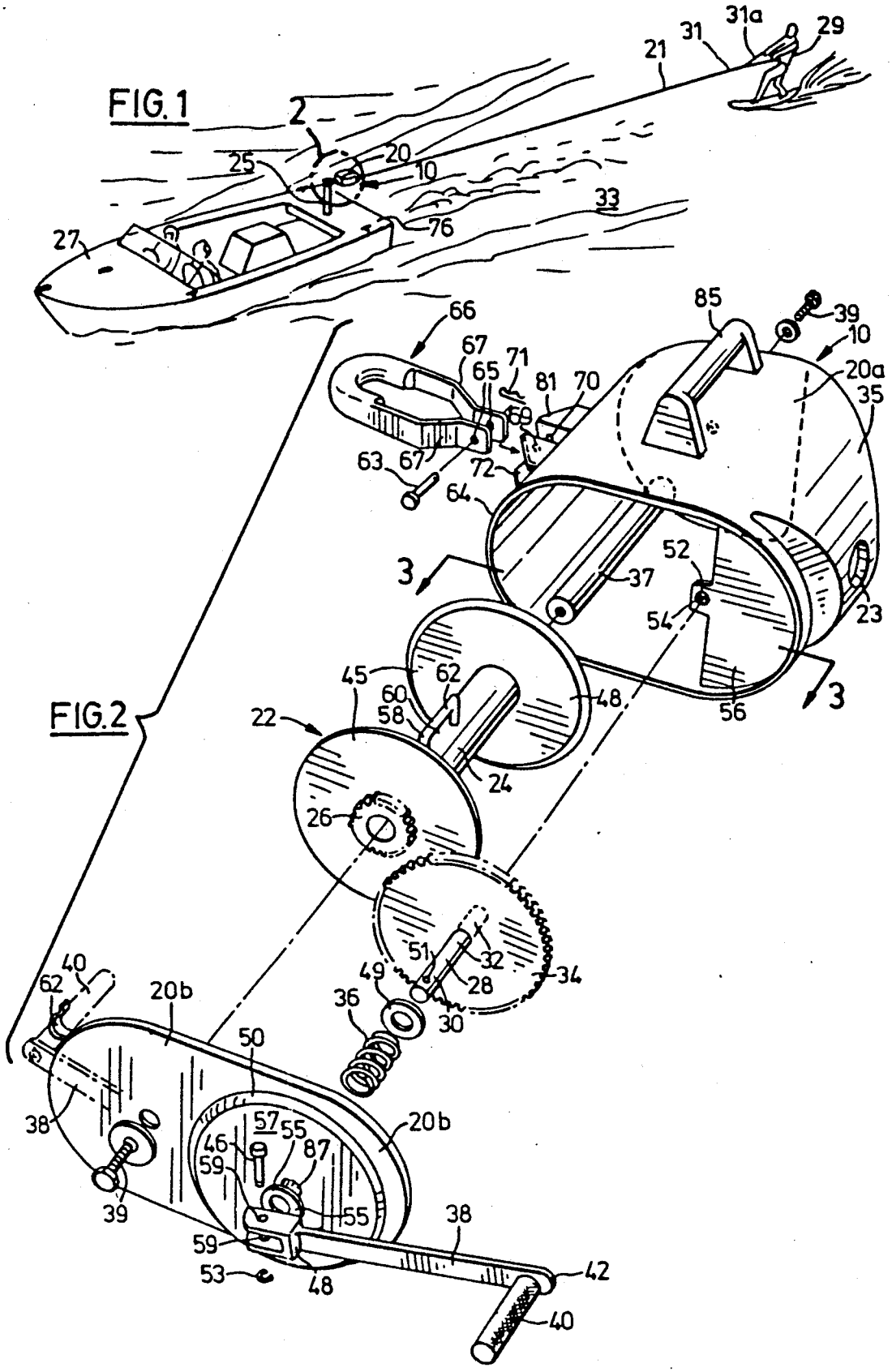
FIG. 1 is a schematic perspective view of a device according to the invention in use with a ski-boat having a conventional ski-post mounted on the stern of the boat, to which post the device is mounted.
FIG. 2 is an exploded perspective view of the device of FIG. 1.

Referring to the drawings, wherein like numerals are used to designate similar parts throughout the various views, there is shown a device 10 for winding and unwinding a waterskiing tow-line 21, the device 10 having a substantially enclosed housing 20, the housing having an opening 23 through which the tow-line 21 may freely pass. As seen in FIG. 1, in use the device 20 is preferably mounted on an upright ski-pole 25 of conventional design, which ski-pole 25 is typically mounted on the rear deck 76 of a ski-boat 27. The precise details of mounting the device 10 are discussed more fully below with specific reference to circled area 2 of FIG. 1 and FIGS. 4 and 5 of the drawings.

In general, to use the device 10, the tow-line 21 is unwound from the device 10, in a manner more fully described below, whereupon the free-end 31 of the tow-line 21, which has a handle means 31*a* is grasped by the skier 29 in a conventional manner. The ski-boat 27 is then driven through the water 33 in a forward direction, thus towing the skier 29 in the same direction. Further details of the manner of usage of the device 10 will become apparent from a full reading of this specification.

Figure 3:
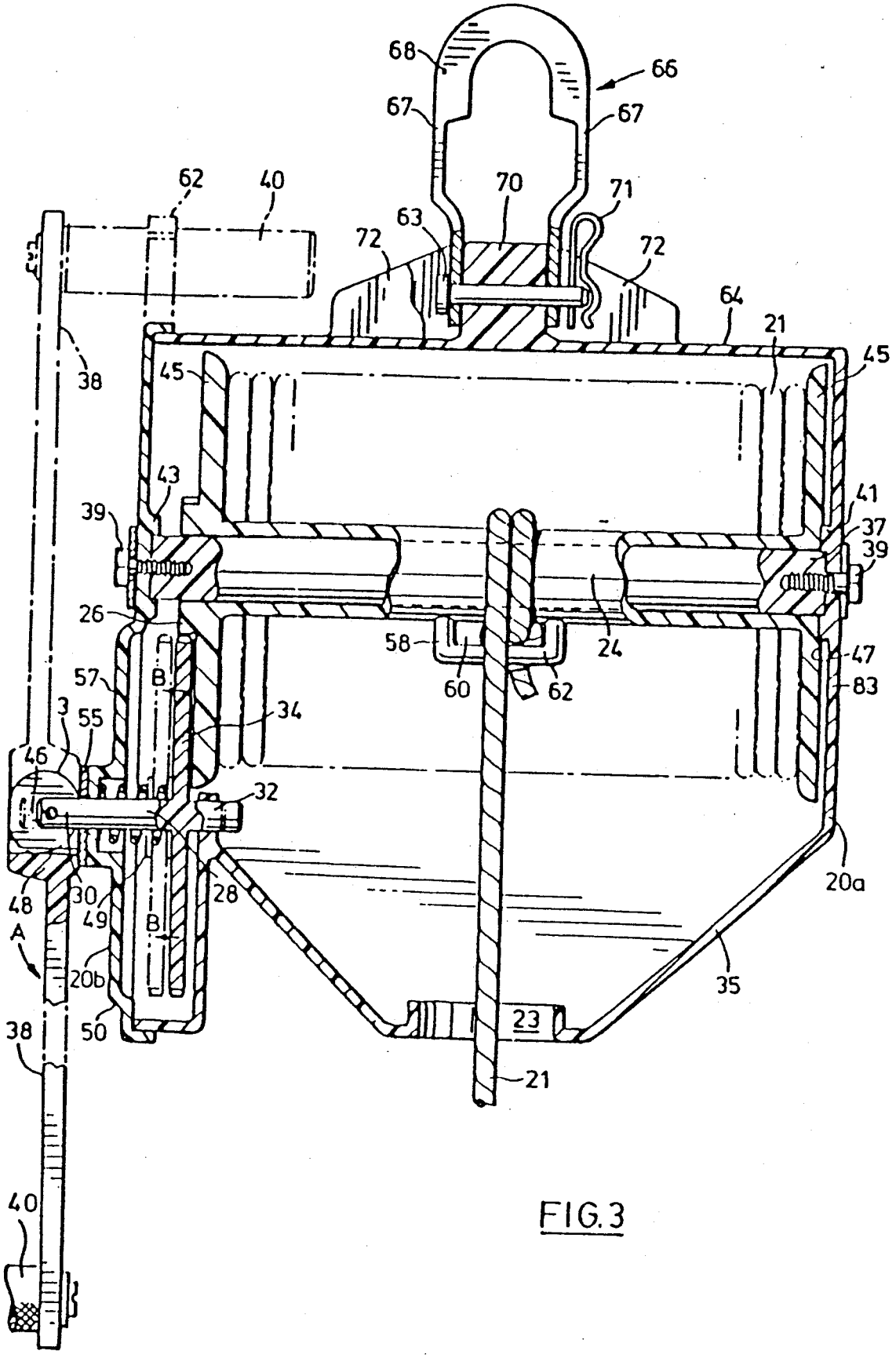
FIG. 3 is a sectional view on line 3—3 of FIG. 2, with the device assembled.

Turning to FIGS. 2 and 3, it will be seen that the housing 20 is comprised of a first main body portion 20*a* and a removable cover portion 20*b*. The opening 23 is centrally positioned in the trailing wall 35 of the main body portion 20*a* in substantial alignment with a centrally disposed axle portion 24 of a spool means 22 mounted for rotation in the housing 20 as follows. A stationary mounting shaft 37 is retained by opposed mounting bolts 39 in opposingly aligned bosses 41, 43 positioned one each, respectively, in the main body portion 20*a* and the cover plate 20*b* of the housing 20. In this manner, the spool means 22, which is comprised of the axle portion 24 and opposite end portions 45, 45 is free to rotate in the housing on the mounting shaft 37. The boss 41 is dimensioned to interact with a corresponding inturned shoulder 47 on the adjacent end portion 45 of the spool means 22, so as to maintain an operative clearance between said end portion 45 and the side wall 83 of the main body portion 20*a* of the housing 20.

A driven gear 26 is mounted on the end portion 45 of the spool means 22 adjacent to the cover portion 20*b* for rotational driving of the spool means 22. In accordance with one embodiment, the housing 20 and the spool means may both be moulded from a substantially rigid plastics material, and the driven gear 26 is integrally moulded with the said end portion 45 of the spool means 22.

A drive shaft 28 is journaled in an aperture 87 of the cover plate 20*b* for rotation of the drive shaft 28 and for axial sliding of the drive shaft 28 relative to the housing 20. The drive shaft 28 has a first end portion 30 protruding from the housing 20 (i.e. through the aperture 87 beyond the cover plate 20*b*) and a second end portion 32 extending into the housing 20. A drive gear 34 is rigidly affixed to the drive shaft 28 for rotation and axial sliding with the drive shaft 28. A coil spring means 36 is mounted in the housing around the drive shaft 28 between the drive gear 34 and the cover plate 20*b*, so as to bias the drive gear 34 (and the attached drive shaft 28) into meshing engagement with the drive gear 26. A wear washer 49 is preferably interposed between the spring means 36 and the drive gear 34, as shown.

A crank member 38 having a handle portion 40 adjacent one end 42 and a yoke portion 48 adjacent the opposite other end 44 is pivotally connected to the first end portion 30 of the drive shaft 28 by means of a pivot pin 46 passing eccentrically through aligned apertures 59, 59 positioned one each in a respective one of the two arm portions 48*a*, 48*a* of the yoke portion 48. By "eccentrically" it is meant that the aligned apertures 59 which accept the pivot pin 46 are positioned eccentrically of the longitudinal axis of the crank member 38.

The pivot pin 46 passes through the apertures 59, 59 and through a correspondingly aligned aperture 51 in the first end 30 of the drive shaft 28, and is held in place by means of a C-clip 53 which is retained in a grove on the free end of the pivot pin 46. A wear washer 55 is preferably positioned on the drive shaft 28 between the yoke arms 48*a*, 48*a* and the outer surface of a raised boss 50 formed in the cover plate 20*b*. It will also be appreciated that the second end 32 of the drive shaft 28 is journaled in a guide hole 52 positioned in an ear 54 of a support plate 56 set back slightly from the side opening of the main body portion 20*a*. It will be immediately appreciated that the drive shaft 28 is free to rotate in the guide hole 52.

With this arrangement, it will be appreciated that the crank member 38 can be pivoted from a first orientation generally transverse to the axis of the drive shaft 28, such orientation being shown in phantom dotted outline in FIGS. 2 and 3, at which first orientation the yoke portion 48 urgingly contacts the outer surface 57 of the boss 50 of the cover plate 20*b* so as to cause axial sliding of the drive shaft 28 in a first axial direction indicated by arrows B, B in FIG. 3 against the biasing of the spring means 36, to cause disengagement of the drive gear 34 from the driven gear 26 (as shown in phantom outline in FIG. 3), so as to allow for free-rotation of the spool means 22 and unwinding of the tow-line 21 from the axle portion 24 of the spool means 22. Moreover, when the crank member 38 is pivotally moved about the pivot pin 46 from the first orientation, shown in phantom outline in FIGS. 2 and 3, in the direction of arrow A of FIG. 2, to a second orientation 180° opposite to said first orientation, which second orientation is shown in solid outline in FIGS. 2 and 3, the yoke portion 48 is removed from said urging contact with the outer surface 57 of the boss 50 of the housing 20, thereby allowing the drive shaft 28 to slide in an axially opposite second direction (180° to the arrows B, B of FIG. 2), under the biasing of the spring means 36, so as to cause engagement of the drive gear 34 with the driven gear 26 thereby to allow for controlled rotation of the spool means 22 upon rotation of the crank member 38 by an operator (not shown) of the device 10. In this manner, the operator is, when the crank member 38 is in said second orientation, able to wind the tow-line 21 around the axle portion 24 of the spool means 22 in a controlled manner so as to retrieve the tow-line. The construction of the device 10 and the gearing are chosen so that such winding may, if necessary, be carried out even while a skier 29 is attached to the free end 31 of the tow-line 21.

It will be appreciated that the aforementioned eccentricity of the aligned apertures 59 and the yoke portion 48 of the crank member 38 are responsible for the urging contact of the housing 20, which in turn causes the axial sliding of the drive shaft in the first axial direction. Accordingly, when the crank member 38 is in the first generally transverse orientation, the position of the pivot pin 46 (shown in phantom in circled area 3 of FIG. 3) is axially outwardly from the housing 20 when compared with the position of the pivot pin 46 when the crank member 38 is in the second transverse orientation shown in solid lines. This translation of the pivot pin 46, of course, results in a similar inward translation of the drive gear 34, so as to cause the aforementioned engagement of the driven gear 26.

The axle portion 24 of the spool means 22 is adapted to initially engage the tow-line 21 by means of raised eye portion 58 centrally positioned on the axle portion 24 of the spool means 22. When initially feeding the tow-line 21 into the device, the tow-line 21 is threaded through the opening 23 in the housing and then through the opening 60 of the eye portion 58, whereafter a knot is advantageously tied in the free end of the tow-line 21 opposite to the skier 29, so that, when the tow-line 21 is completely unwound, it will not release itself from the axle portion 24 of the spool means 22. Once the tow-line 21 is affixed to the axle portion in this manner, the spool means 22 is rotated in the manner previously indicated, so as to cause the cross-member 62 of the eye portion 59 to grip the tow-line 21 and cause wrapping of the tow-line 21 around the axle portion 24.

The step-up gearing ratios shown facilitate quick up-take of an unwound tow-line on to the spool means 22, and are not designed for ease of reeling in a tow-line in its loaded configuration. However, the gear ratio (between the drive gear 34 and driven gear 26) is a mere matter of design choice, and can be readily varied in the design phase so as to accommodate various planned applications. It has been found by the applicant, that a step-up gear ratio of approximately 3:1, as shown, provides a wide range of use applications, but the invention is in no way restricted to such a step-up gear mechanism or ratio.

As the tow-line 21 is wound upon the axle portion 24 by user rotation of the crank member 38 in its second orientation (shown in solid outline in FIG. 2) the rope will naturally and quite evenly distribute itself back and forth along the axle portion 24, such that when the tow-line 21 is fully retracted, it will assume a position between the end portions 45 of the spool means 22, as shown in phantom outline in FIG. 3.

A retention clip 62 is advantageously affixed to the cover plate 20*b* of the housing 20 to retain the handle portion 40 of the crank member 38 in the first orientation shown in phantom outline in FIGS. 2 and 3, so as to maintain the device in the free-wheeling configuration previously described, thus allowing full pay-out of the tow-line 21. When it is desired to retract the tow-line 21, such as after the skier is finished skiing, the handle portion 40 of the crank member 38 is removed from the retaining clip 62 by partial upward pivoting of the crank member 38, whereafter the crank member 38 is pivoted about the pivot pin 59 to the second orientation shown in solid outline in FIGS. 2 and 3, whereafter, rotation of the crank member in either direction will cause retraction of the tow-line 21 and subsequent winding about the axle portion 24.

Figure 4:
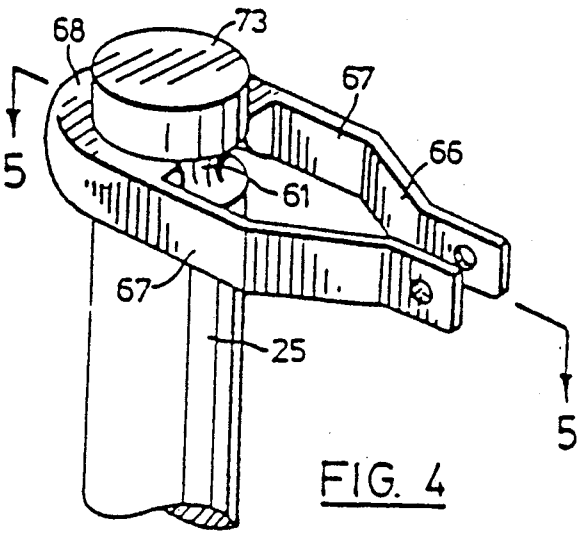
FIG. 4 is a detailed perspective view of area 2 of FIG. 1.
Figure 5:
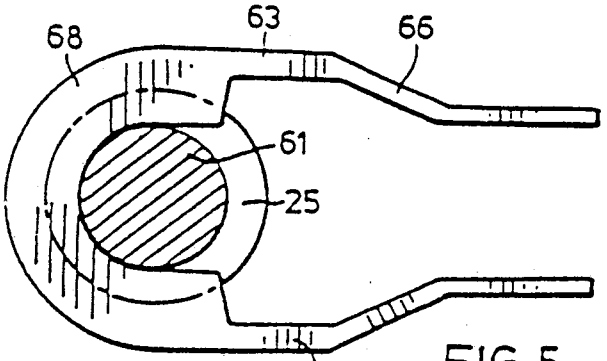
FIG. 5 is a sectional view on line 5—5 of FIG. 4.

As previously mentioned, it is an object of the present invention to provide a device which is quickly and easily detachable from a ski-boat for storage once the tow-line 21 has been retracted. Moreover, it is the stated object of this invention to provide a tow-line winding and unwinding device which may be used with existing tow-line fittings commonly installed on ski-boats. With this in mind, there is shown in FIGS. 1, 4 and 5 a conventional ski-post 25, which post 25 is mounted on the rear deck 76 of the ski-boat 27 by screws or other conventionaly affixation means (not shown). In conventional applications not utilizing a winding or unwinding device, the tow-line 21 is tied into a loop (not shown) at the end opposite from the skier 29, and the loop is simply placed around the reduced diameter end portion 61 of the ski-post 25. When skiing is completed, the loop is released from the reduced diameter end portion 61 and the rope is manually hauled back into the ski-boat 27. In contrast, the device 10 of the present invention is quickly and easily mounted on the reduced diameter end portion 61 by means of a U-shaped shackle means 66 having arms 67, 67 which are dimensioned at their juncture to slidingly receive the reduced diameter end portion 61 of the ski-post 25. The juncture portion 68 of the shackle means 66 is contoured to be held snugly on the reduced diameter end portion 61 of the ski-post 25, so as to hold the shackle means 66 in substantially transverse relation to the longitudinal axis of the ski-post 25. An optional retaining clip (not shown) may, after insertion of the shackle means 66 on the ski-post 25 (as shown), be inserted between the arms 67, 67 so as to prevent unintended slippage of the shackle means 66 from the ski-post 25.

The shackle means 66 is detachably affixed to the leading wall 64 of the main body portion 20*a* of the housing 20 by means of a removable pivot pin 63 passing through aligned apertures 65, 65 in the respective arms 67, 67 of the shackle means 66, and through an aperture 69 passing through an ear portion 70 rigidly affixed to the leading wall 64 of the main body portion 20*a*. As shown, the ear 70 is preferably intersected at its bottom extent by a lower supporting flange 72, and at its upper extent by an upper supporting flange 81, which supporting flanges allow only a limited pivoting of the housing 20 about the pivot pin 63, so as to keep the device 10 in a substantially horizontal operative orientation, as shown in FIG. 1. Thus, the lower 72 and upper 81 support flanges together limit the pivot travel of the shackle means 66 to an operative range. A removable spring clip 71 intersects a terminal aperture of the pivot pin 63 so as to retain the pivot pin 63 in the engaged relation shown in FIG. 3. In this manner, the device 10 is releasably secured to the ski-post 25 without the use of hand tools, and can be quickly dismounted therefrom by removal of the pivot pin 63, or, by rearward sliding of the shackle means 66 and device 10, followed by upward lifting of the shackle means 66/device 10 combination so as to clear the terminal end 73 of the ski-post 25. A lifting handle 85 is preferably fitted to the top of the main body portion 20*a* of the housing 20 to facilitate lifting of the device 10.

Figure 6:
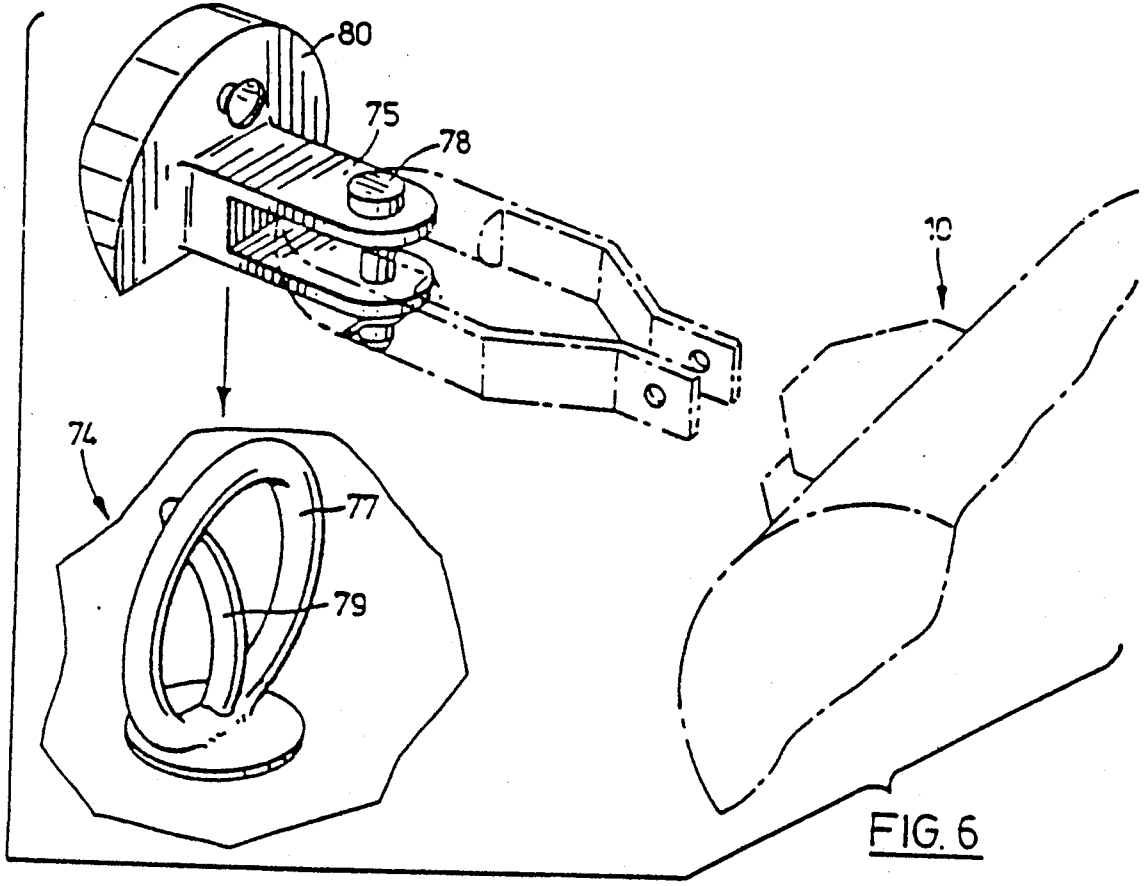
FIG. 6 is a perspective view in an unassembled configuration and partly in phantom, of an alternative means of mounting the device of FIGS. 2 and 3 on a ski-boat.
Figure 8:
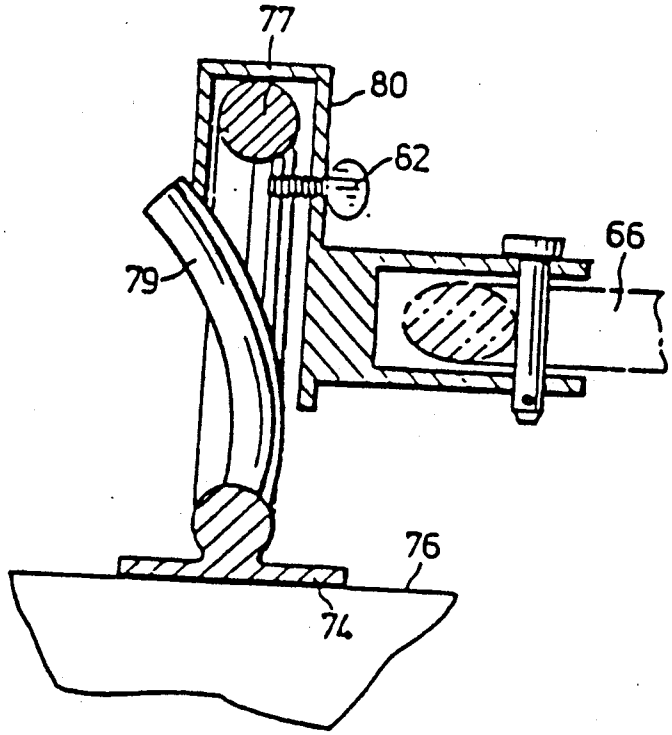
FIG. 8 is a sectional view on line 8—8 of FIG. 7.
Figure 7:
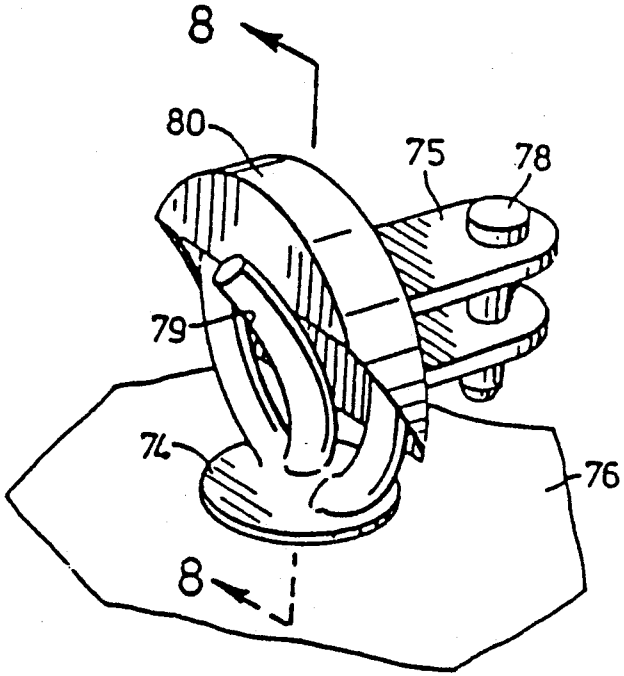
FIG. 7 is a perspective view showing the alternative mounting means of FIG. 6 in an assembled configuration.

An alternative method of mounting the device 10 of the invention on a ski-boat 27 fitted with a well known form of conventional ski-pin fastener is shown in FIGS. 6, 7 and 8. The conventional ski-pin fastener shown in FIGS. 6, 7 and 8 is designated by the general reference numeral 74. The ski-pin fastener 74 is mounted on the rear deck or other horizontal surface 76 of the ski-boat 27 by conventional fastening means, (not shown). The ski-pin fastener 74 typically comprises a rope eye portion 77 which surrounds a centrally positioned ski-pin 79, which ski-pin slants forwardly in relation to the ski-boat 27. To accommodate mounting of the device 10 with such a ski-pin fastener 74, there is additionally provided a supplementary yoke means 75, which means is adapted to be pivotally engaged by the shackle means 66, acting through yet another pivot pin 78. The supplementary yoke means 75 presents at the end opposite to the pivot pin 78 a terminal cap portion 80, which terminal cap portion 80 is dimensioned to frictionally overlie and surround the rope eye portion 77, as best seen in FIGS. 7 and 8. A thumb screw 82 is preferably positioned on the cap portion 80 so as to engage an inner surface of the rope eye 77 to snugly hold the cap portion 80 thereon. When it is desired to remove the device 10 from the rear deck 76 of the ski-boat 74, the thumb screw is simply loosened and the entire assembly, consisting of the cap portion 80, shackle means 66 and the attached device 10 is lifted free and clear of the ski-pin fastener 74 for subsequent stowage in the ski-boat 27.

Figure 9:
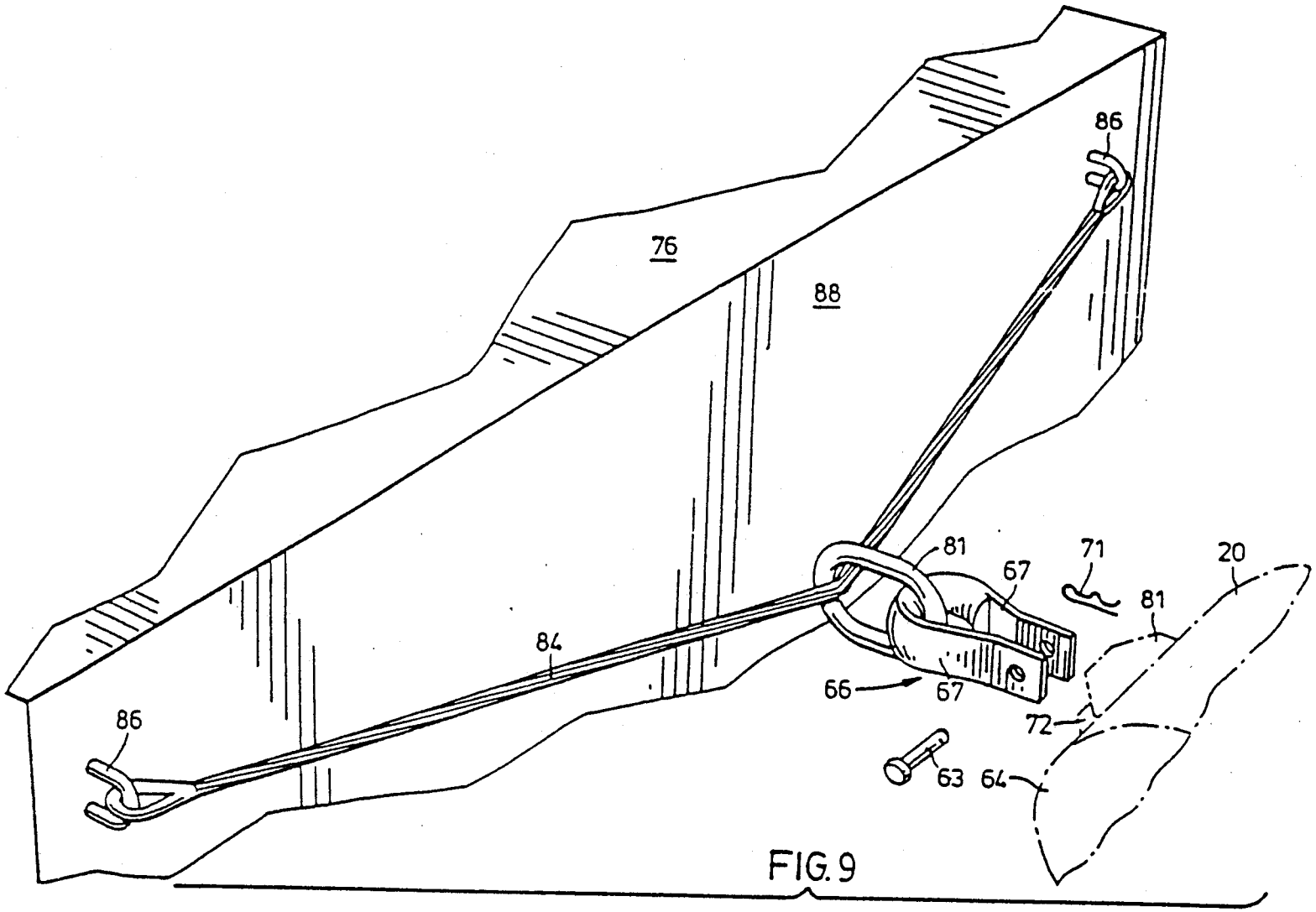
FIG. 9 is a perspective view of yet another alternative means of mounting the device of FIGS. 2 and 3 on a ski-boat.

Yet a third mounting means of the device 10 is shown in FIG. 9. This arrangement is somewhat archaic when compared to the two previous arrangements shown in FIGS. 4–6 and 7–8, respectively, but may still be used with boats 27 having transom mounted skiing set-ups. With such a set-up, a rope 84, looped at either end, engages two spaced apart U-bolts 86, 86 affixed to the rear transom 88 of the ski-boat 27. To accommodate this type of mounting, a simple closed ring member 81 is additionally provided with the shackle means 66 to encircle both the rope 84 and the juncture portion 68 of the shackle means 66, prior to the shackle means being attached, by means of pivot pin 63, to the ear 70 positioned between the lower 72 and upper 81 support flanges mounted on the leading wall 64 of the housing 20. To release the device 10 from the ski-boat for stowage, the spring clip 71 is simply released from the pivot pin 63, as previously described, and the device 10 is thereafter detached from the shackle means 66. Shackle means 66 can then simply be removed from the ring 81 for stowage.

It will thus be seen from the foregoing description that the device 10 of the present invention is not only simple to construct and easy to use, but is also simply and quickly mounted upon a ski-boat 27 without the use of hand tools, and without the addition of non-conventional fixtures to the ski-boat 27.

While but one specific embodiment of the device and three specific embodiments of mounting means suitable for use with the device 10 are herein shown and described, it will be understood that various changes in size, shape and arrangement of parts and substitution of materials may be made without departing from the spirit and the scope of the invention as claimed herein. For example, the housing 20 as illustrated is shown to be constructed from a metal material. However, it will be readily apparent and it is fully contemplated by this invention that substantially all of the device of the invention can be routinely constructed from modern plastics materials or polyamide materials, such as Nylon (Trade Mark). Moreover, a separate mounting shaft 37 as illustrated, is not necessary. Rather, it would be simpler, and more cost effective to mould the spool means, and the mounting shaft 37 of unitary construction, in which case the mounting bolts 39 would not be necessary. That is, the two stub axles thus formed would effectively protrude from either end of the spool means so as to be simply mounted in the bosses 43 and 41 for rotation therein. These and other simplifications of structure and substitution of equivalent materials and means are matters of mere design choice and are fully within the scope of the appended claims.

The embodiments of the invention in which an exclusive property or privilege is claimed are defined as follows:

1. A device for winding and unwinding a water skiing tow-line, the device comprising:

a substantially enclosed housing having an opening through which the tow-line may freely pass;

a spool means mounted for rotation in the housing and adapted for retaining the tow-line in winding relation around a centrally disposed axle portion;

a driven gear mounted on the spool means for rotational driving thereof;

a drive shaft journaled in the housing for rotation and for axial sliding relative to the housing and having a first end portion protruding from the housing and a second end portion extending into the housing;

a drive gear affixed to the drive shaft for rotation and for axial sliding with the drive shaft;

a spring means mounted in the housing and adapted for biasing the drive gear into meshing engagement with the driven gear;

a crank member having a handle portion on one end and an integral yoke portion on the opposite other end, the crank member being pivotally connected to the second end portion of the drive shaft by means of a pivot pin passing eccentrically through the yoke portion and the second end portion, such that, upon pivoting movement of the crank member to a first orientation generally transverse to the axis of the drive shaft, the yoke portion urgingly contacts the housing so as to cause axial sliding of the drive shaft in a first axial direction against the biasing of the spring means, thereby causing disengagement of the drive gear from the driven gear, so as to allow for free-rotation of the spool means and unwinding of the tow-line from said axle portion of the spool means, and such that, upon pivoting movement of the crank member to a second orientation 180° opposite to said first orientation, the yoke portion is removed from said contact with the housing so as to allow the drive shaft to slide in an axially opposite second direction under biasing of the spring means thereby to cause engagement of the drive gear with the driven gear so as to allow for controlled rotation of the spool means upon rotation of the crank member, thereby to wind the tow-line around said axle portion of the spool means.

2. The device of claim 1, including generally U-shaped shackle means having arms extending from a common, mutually connecting portion with the arms affixed at respective ends thereof spaced apart from the connecting portion, to the leading wall of the housing in protruding relation therefrom, so as to allow for releasable attachment of the device to a ski-boat.

3. The device of claim 2, wherein the arms of said shackle means are detachably affixed to the leading wall of the housing as aforesaid by means of a removable pivot pin.

4. The device of claim 1, wherein the housing is moulded from a substantially rigid plastics material.

5. The device of claim 1, wherein the housing and the spool means are both moulded from a substantially rigid plastics material.

6. The device of claim 5, wherein the driven gear is integrally moulded with the spool means.

7. The device of claim 1, wherein the housing is moulded from a polyamide material.

8. The device of claim 1, wherein both the housing and the spool means are moulded from a polyamide material.

9. The device of claim 8, wherein the driven gear is integrally moulded with the spool means.

* * * * *